US010194254B2

(12) United States Patent
Johansson

(10) Patent No.: US 10,194,254 B2
(45) Date of Patent: Jan. 29, 2019

(54) ISOLATED ACTUATOR FOR BONE CONDUCTION DEVICE

(71) Applicant: COCHLEAR LIMITED, Macquarie University (AU)

(72) Inventor: Fredrik Johansson, Mölnlycke (SE)

(73) Assignee: COCHLEAR LIMITED, Macquarie University (AU)

( * ) Notice: Subject to any disclaimer, the term of this patent is extended or adjusted under 35 U.S.C. 154(b) by 118 days.

(21) Appl. No.: 15/380,357

(22) Filed: Dec. 15, 2016

(65) Prior Publication Data

US 2017/0180891 A1 Jun. 22, 2017

Related U.S. Application Data

(60) Provisional application No. 62/268,395, filed on Dec. 16, 2015.

(51) Int. Cl.
*H04R 25/00* (2006.01)

(52) U.S. Cl.
CPC ..... *H04R 25/606* (2013.01); *H04R 25/456* (2013.01); *H04R 2460/13* (2013.01)

(58) Field of Classification Search
CPC ..... H04R 25/456; H04R 25/60–25/608; H04R 25/658; H04R 2225/021
See application file for complete search history.

(56) References Cited

U.S. PATENT DOCUMENTS

2013/0114834 A1* 5/2013 Bern ..... H04R 25/606 381/151
2013/0165738 A1* 6/2013 Ball ..... H04R 25/02 600/25
2014/0012069 A1* 1/2014 Ball ..... A61N 1/375 600/25
2014/0270293 A1* 9/2014 Ruppersberg ..... H04R 25/606 381/318
2015/0049889 A1 2/2015 Bern
2016/0345110 A1* 11/2016 Gustafsson ..... H04R 25/606

* cited by examiner

*Primary Examiner* — Catherine B Kuhlman
(74) *Attorney, Agent, or Firm* — Merchant & Gould P.C.

(57) ABSTRACT

A bone conduction device utilizes discrete retention magnets to secure both a sound processor housing and a vibration actuator to a head of a recipient. Only an electrical lead connects the sound processor housing and the vibration actuator. As such, the sound processor housing and the vibration actuator are mechanically separated. This mechanical separation helps reduce or eliminate vibration transmission between the two components, thus reducing feedback caused by the vibrations.

20 Claims, 11 Drawing Sheets

ISOLATED ACTUATOR FOR BONE CONDUCTION DEVICE

CROSS REFERENCE TO RELATED APPLICATION

This application claims priority to U.S. Ser. No. 62/268,395, titled ISOLATED ACTUATOR FOR BONE CONDUCTION DEVICE, filed on Dec. 16, 2015, the disclosure of which is hereby incorporated by reference in its entirety.

BACKGROUND

Hearing loss, which can be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient (i.e., the inner ear of the recipient) to bypass the mechanisms of the middle and outer ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain, the ear drum or the ear canal. Individuals suffering from conductive hearing loss can retain some form of residual hearing because some or all of the hair cells in the cochlea function normally.

Individuals suffering from conductive hearing loss often receive a conventional hearing aid. Such hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to conventional hearing aids, which rely primarily on the principles of air conduction, certain types of hearing prostheses commonly referred to as bone conduction devices, convert a received sound into vibrations. The vibrations are transferred through the skull to the cochlea causing motion of the perilymph and stimulation of the auditory nerve, which results in the perception of the received sound. Bone conduction devices are suitable to treat a variety of types of hearing loss and can be suitable for individuals who cannot derive sufficient benefit from conventional hearing aids.

SUMMARY

The technologies described herein physically separate the vibration actuator from the housing containing the sound processor and microphone by utilizing separate retention elements for each component. This results in a significant reduction in structural vibrations reaching the microphones, thus reducing feedback through the housing to the microphones. In examples, the only continuous connection between the vibration actuator and the sound processor housing is by one or more electric wires. As the prosthesis is mounted on the head, the vibration actuator is held by using an engagement element that retains the vibration actuator in a desired position. Once the retention magnets have attracted the vibration actuator and sound processor housing to corresponding implanted retention magnets, the engagement element is released and the vibration actuator is positioned so as to maintain clearance from the sound processor housing. In another example, a mechanical stop can prevent the vibration actuator from becoming separated from the sound processor housing.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

A bone conduction auditory prosthesis transfers vibration to the skull. Since a microphone and actuator of the prosthesis are disposed on the same external housing, feedback from a vibration actuator to the microphone can result. In an example, a percutaneous bone conduction device utilizes an anchor that penetrates the skin of the head to secure the device to the recipient. In a transcutaneous bone conduction device, one or two retention magnets disposed in an external portion thereof interact with implantable retention magnet(s) disposed in an implantable portion of the device. By utilizing the technologies described herein, the portion of the bone conduction device that receives sound can be mechanically isolated or separated from the portion of the bone conduction device that delivers a vibrational stimulus to a recipient.

Figure 1A:
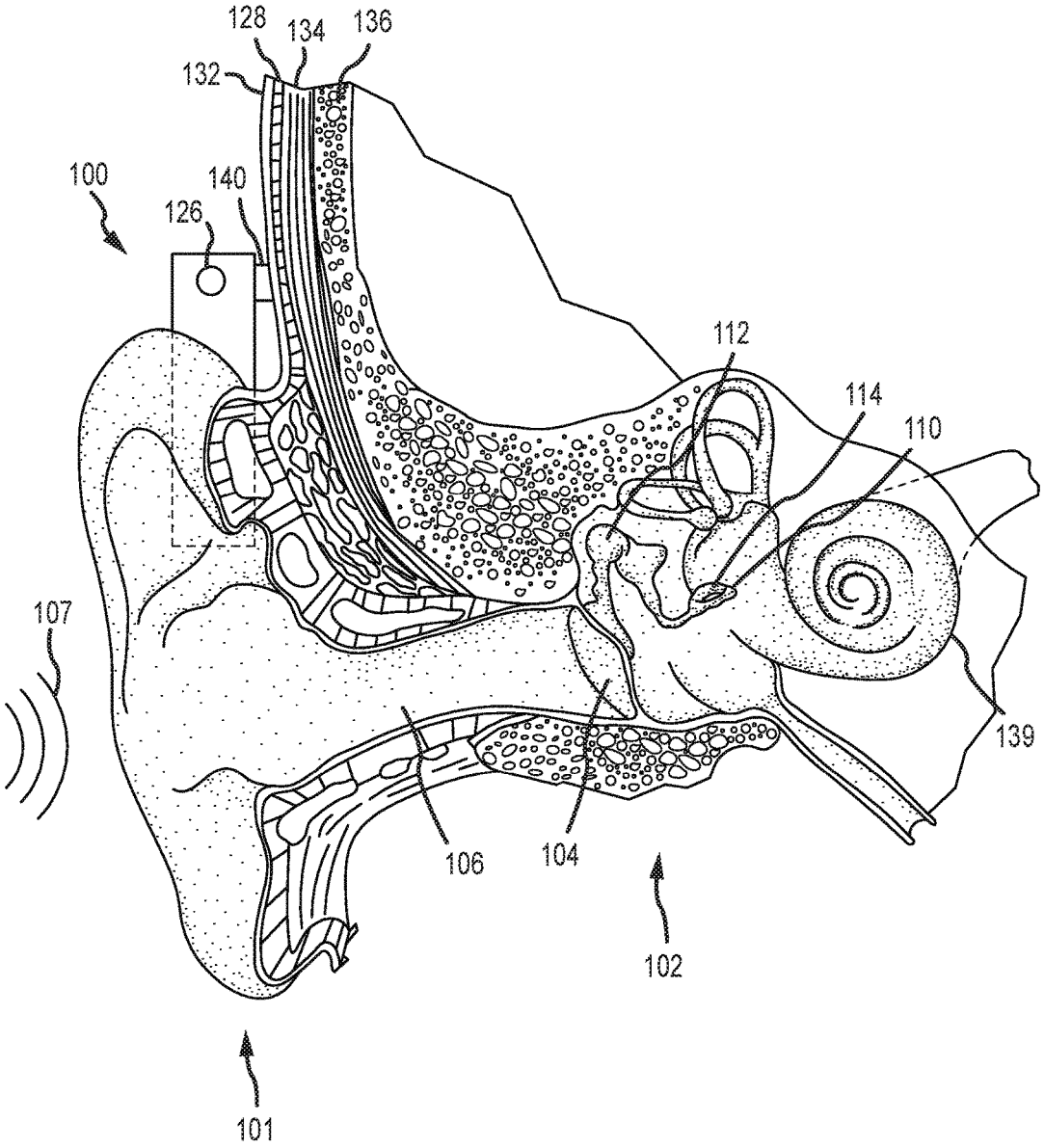
FIG. 1A depicts a partial perspective view of a percutaneous bone conduction device worn on a recipient.

FIG. 1A depicts a partial perspective view of a percutaneous bone conduction device 100 positioned behind outer ear 101 of the recipient and includes a sound input element 126 to receive sound signals 107. The sound input element 126 can be a microphone, telecoil, or similar. In the present example, sound input element 126 can be located, for example, on or in bone conduction device 100, or on a cable extending from bone conduction device 100. Also, bone conduction device 100 includes a sound processor (not shown), a vibrating electromagnetic actuator and/or various other operational components.

More particularly, sound input device 126 converts received sound signals into electrical signals. These electrical signals are processed by the sound processor. The sound processor generates control signals that cause the actuator to vibrate. In other words, the actuator converts the electrical signals into mechanical force to impart vibrations to skull bone 136 of the recipient.

Bone conduction device 100 further includes coupling apparatus 140 to attach bone conduction device 100 to the recipient. In the example of FIG. 1A, coupling apparatus 140 is attached to an anchor system (not shown) implanted in the recipient. An exemplary anchor system (also referred to as a fixation system) can include a percutaneous abutment fixed to the recipient's skull bone 136. The abutment extends from skull bone 136 through muscle 134, fat 128, and skin 132 so that coupling apparatus 140 can be attached thereto. Such a percutaneous abutment provides an attachment location for coupling apparatus 140 that facilitates efficient transmission of mechanical force.

It is noted that sound input element 126 can include devices other than a microphone, such as, for example, a telecoil, etc. Sound input element 126 can also be a component that receives an electronic signal indicative of sound, such as, from an external audio device. For example, sound input element 126 can receive a sound signal in the form of an electrical signal from an MP3 player or a smartphone electronically connected to sound input element 126.

The sound processing unit of the auditory prosthesis processes the output of the sound input element 126, which is typically in the form of an electrical signal. Sound processing unit generates control signals that cause an associated actuator to vibrate. These mechanical vibrations are delivered by the external portion of the auditory prosthesis 100, as described below.

Figure 1B:
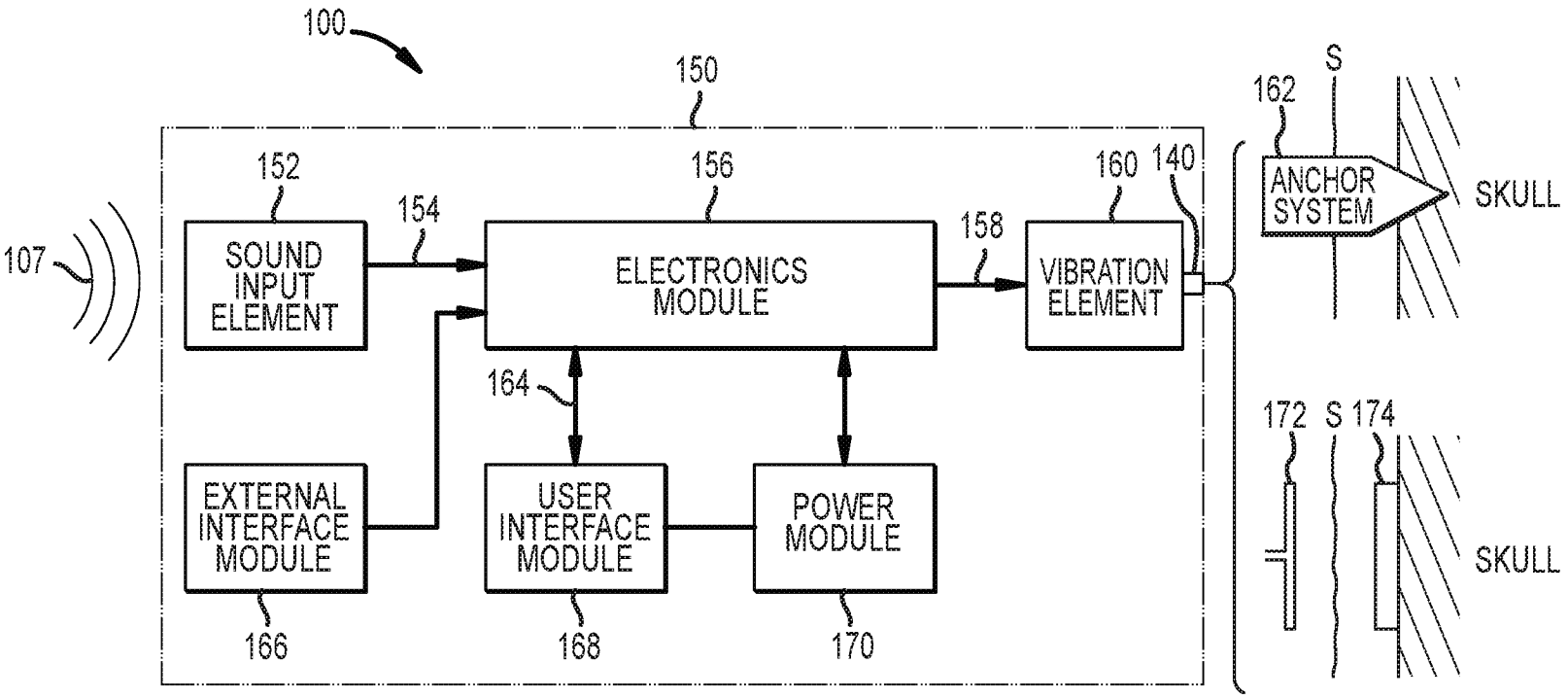
FIG. 1B is a schematic diagram of a bone conduction device.

FIG. 1B is a schematic diagram of a bone conduction device 100 that may be either a percutaneous or transcutaneous bone conduction device. Sound 107 is received by sound input element 152. In some arrangements, sound input element 152 is a microphone configured to receive sound 107, and to convert sound 107 into electrical signal 154. Alternatively, sound 107 is received by sound input element 152 as an electrical signal. As shown in FIG. 1B, electrical signal 154 is output by sound input element 152 to electronics module 156. Electronics module 156 is configured to convert electrical signal 154 into adjusted electrical signal 158. As described below in more detail, electronics module 156 can include a sound processor, control electronics, transducer drive components, and a variety of other elements.

As shown in FIG. 1B, vibration element or actuator 160 receives adjusted electrical signal 158 and generates a mechanical output force in the form of vibrations that are delivered to the skull of the recipient via a transmission element 140, often in the form of a shaft extending from the vibration actuator 160. Transmission of vibration can be via a number of different systems, depending on the type of bone conduction device. For example, in a percutaneous bone conduction device, the transmission element 140 can be connected to an anchor system 162, such as a bone screw that penetrates the skin S of the recipient and is secured directly to the skull. In a transcutaneous bone conduction device, the transmission element 140 can be connected to a transmission plate 172 that is disposed against the skin S of the recipient. This plate 172 is magnetically engaged with an implanted retention magnet 174, so as to transmit vibrations to the skull. The implanted magnet 174 is typically anchored to the skull by a bone screw, multiple bone screws, bone cement or similar bone securement. Engagement between the transmission element 140 and either the percutaneous bone screw 162 or the transmission plate 172 is often via a mechanical engagement device (e.g., a snap connector). Delivery of an output force from the actuator 160 to the bone anchor 162, 174 causes motion or vibration of the recipient's skull, thereby activating the hair cells in the recipient's cochlea (not shown) via cochlea fluid motion.

FIG. 1B also illustrates power module 170. Power module 170 provides electrical power to one or more components of bone conduction device 100. For ease of illustration, power module 170 has been shown connected only to user interface module 168 and electronics module 156. However, it should be appreciated that power module 170 can be used to supply power to any electrically powered circuits/components of bone conduction device 100.

User interface module 168, which is included in bone conduction device 100, allows the recipient to interact with bone conduction device 100. For example, user interface module 168 can allow the recipient to adjust the volume, alter the speech processing strategies, power on/off the device, etc. In the example of FIG. 1B, user interface module 168 communicates with electronics module 156 via signal line 164.

Bone conduction device 100 can further include external interface module that can be used to connect electronics module 156 to an external device, such as a fitting system. Using external interface module 166, the external device, can obtain information from the bone conduction device 100 (e.g., the current parameters, data, alarms, etc.) and/or modify the parameters of the bone conduction device 100 used in processing received sounds and/or performing other functions.

In the example of FIG. 1B, sound input element 152, electronics module 156, vibration element 160, power module 170, user interface module 168, and external interface module have been shown as integrated in a single housing, referred to as housing 150. However, it should be appreciated that in certain examples, one or more of the illustrated components can be housed in separate or different housings. For example, the sound input element 152 and electronics module 156 can be disposed in a BTE device that is physically isolated from the actuator. Similarly, it should also be appreciated that in such aspects, direct connections between the various modules and devices are not necessary and that the components can communicate, for example, via wireless connections.

Figure 2:
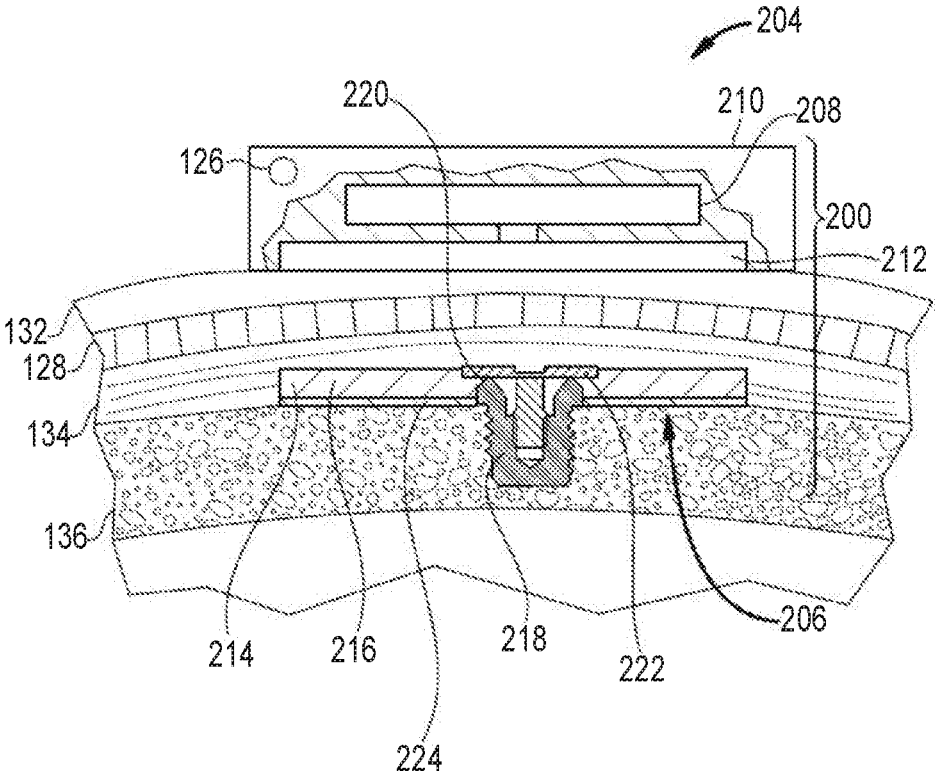
FIG. 2 depicts a cross-sectional schematic view of a passive transcutaneous bone conduction device worn on a recipient.

FIG. 2 depicts an example of a transcutaneous bone conduction device 200 that includes an external portion 204 and an implantable portion 206. The transcutaneous bone conduction device 200 of FIG. 2 is a passive transcutaneous bone conduction device in that a vibrating actuator 208 is located in the external portion 204. Vibrating actuator 208 is located in housing 210 of the external component, and is coupled to plate 212. Plate 212 can be in the form of a permanent retention magnet, a group of magnets, and/or in another form that generates and/or is reactive to a magnetic field, or otherwise permits the establishment of magnetic attraction between the external portion 204 and the implantable portion 206 sufficient to hold the external portion 204 against the skin of the recipient. Magnetic attraction can be further enhanced by utilization of a magnetic implantable plate 216. A single external retention magnet 212 and a single implantable retention magnet 216, are depicted in FIG. 2. In alternative embodiments, two or more magnets in both the external portion 204 and implantable portion 206 can be utilized. In a further alternative embodiment the plate 212 can include an additional plastic or biocompatible housing (not shown) that encapsulates magnets and contacts the skin of the recipient.

The vibrating actuator 208 is a device that converts electrical signals into vibration. In operation, sound input element 126 converts sound into electrical signals. Specifically, the transcutaneous bone conduction device 200 provides these electrical signals a sound processor (not shown) that processes the sounds. Additional elements, such as the interface and power modules depicted in the percutaneous bone conduction device of FIG. 1B are not depicted, but are typically included. The vibrating actuator 208 converts the electrical signals into vibrations. Because vibrating actuator 208 is mechanically coupled to plate 212, the vibrations are transferred from the vibrating actuator 208 to plate 212. Implantable plate assembly 214 is part of the implantable portion 206, and is made of a ferromagnetic material that can be in the form of a permanent magnet, that generates and/or is reactive to a magnetic field, or otherwise permits the establishment of a magnetic attraction between the external portion 204 and the implantable portion 206 sufficient to hold the external portion 204 against the skin 132 of the recipient. Additional details regarding the retention magnets that can be utilized in both the external portion 204 and the implantable portion 206 are described in more detail herein. Accordingly, vibrations produced by the vibrating actuator 208 of the external portion 204 are transferred from plate 212 across the skin 132 to implantable plate 216 of implantable plate assembly 214. This can be accomplished as a result of mechanical conduction of the vibrations through the skin 132, resulting from the external portion 204 being in direct contact with the skin 132 and/or from the magnetic field between the two plates 212, 216. These vibrations are transferred without a component penetrating the skin 132, fat 128, or muscular 134 layers on the head.

As can be seen, the implantable plate assembly 214 is substantially rigidly attached to bone fixture 220 in this embodiment. Implantable plate assembly 214 includes through hole 220 that is contoured to the outer contours of the bone fixture 218, in this case, a bone screw that is secured to the bone 136 of the skull. This through hole 220 thus forms a bone fixture interface section that is contoured to the exposed section of the bone fixture 218. In an exemplary embodiment, the sections are sized and dimensioned such that at least a slip fit or an interference fit exists with respect to the sections. Plate screw 222 is used to secure implantable plate assembly 214 to bone fixture 218. As can be seen in FIG. 2, the head of the plate screw 222 is larger than the hole through the implantable plate assembly 214, and thus the plate screw 222 positively retains the implantable plate assembly 214 to the bone fixture 218. In certain embodiments, a silicon layer 224 is located between the implantable plate 216 and bone 136 of the skull.

The bone conduction devices described herein utilize a vibration actuator that is mechanically separate from, but contained within, the bone conduction device housing. Since the bone conduction device housing includes a sound processor, microphones, and other components susceptible to feedback, it is advantageous to separate the vibration actuator therefrom so as to reduce or eliminate feedback through the housing. As such, the devices described herein utilize one or more components to reduce paths for feedback within the device, certain examples of which are described below.

Typically, a single retention magnet (or set of retention magnets) is utilized (as described in FIG. 2 above) to hold a conventional bone conduction device to the recipient (by mechanically engaging with an implanted magnet or magnet set). One way to separate the vibration actuator from the housing is to utilize discrete retention magnets for each of the vibration actuator and the housing. As such, the examples described below use a housing retention magnet disposed on the housing to retain the housing to an implanted housing retention magnet, while utilizing a discrete vibration actuator retention magnet disposed on the vibration actuator to retain the vibration actuator to an implanted vibration actuator retention magnet. In this regard, the vibration actuator is connected to the housing (the sound processor contained therein) only via a wired connection. Since the vibration actuator is nested within the housing, it is difficult to remove the housing and vibration actuator from the head of the recipient without potentially damaging or breaking this wire. By making the wire more robust, this provides a path for feedback to the sound processor in the housing. Additionally, certain examples described herein utilize a resilient sealing element between the vibration actuator and the housing so as to prevent the ingress of water, dirt, or other debris. If this sealing element is made too robust (so as to sufficiently hold the vibration actuator in the housing during removal), vibration transmission through the sealing element increases.

As such, simply using a heavier gauge wire or a thicker sealing element are not desirable solutions to retain the vibration actuator within the housing. Instead, in addition to dedicated magnets for each component, the technologies described herein utilize passive and/or active engagement elements that robustly retain as a single unit the vibration actuator to the housing during application and removal, but that disengage those components when worn on the recipient during use (more specifically once each component is engaged with its dedicated implant magnet). Passive engagement elements are mechanical stops that generally engage without action on the part of the recipient during application and removal of the device. These can include, generally, surfaces or elements that automatically engage when one component (e.g., the housing) is moved a certain amount relative to the other element (e.g., the vibration actuator). For a device utilizing passive engagement elements, the recipient can grasp and pull the housing to remove it. Once the housing has moved a predetermined distance, the passive engagement elements engage, thus compelling movement of the vibration actuator. The housing and vibration actuator are now a single unit and can be transported, serviced, stored, etc., without damage to either component. Active engagement elements require action on the part of the recipient during application and removal. These include engaging elements that are activated by the recipient. In an example, the recipient can engage the active engagement element so as to fix movement of the vibration actuator with movement of the housing, prior to removal or application of the device.

Figure 3:
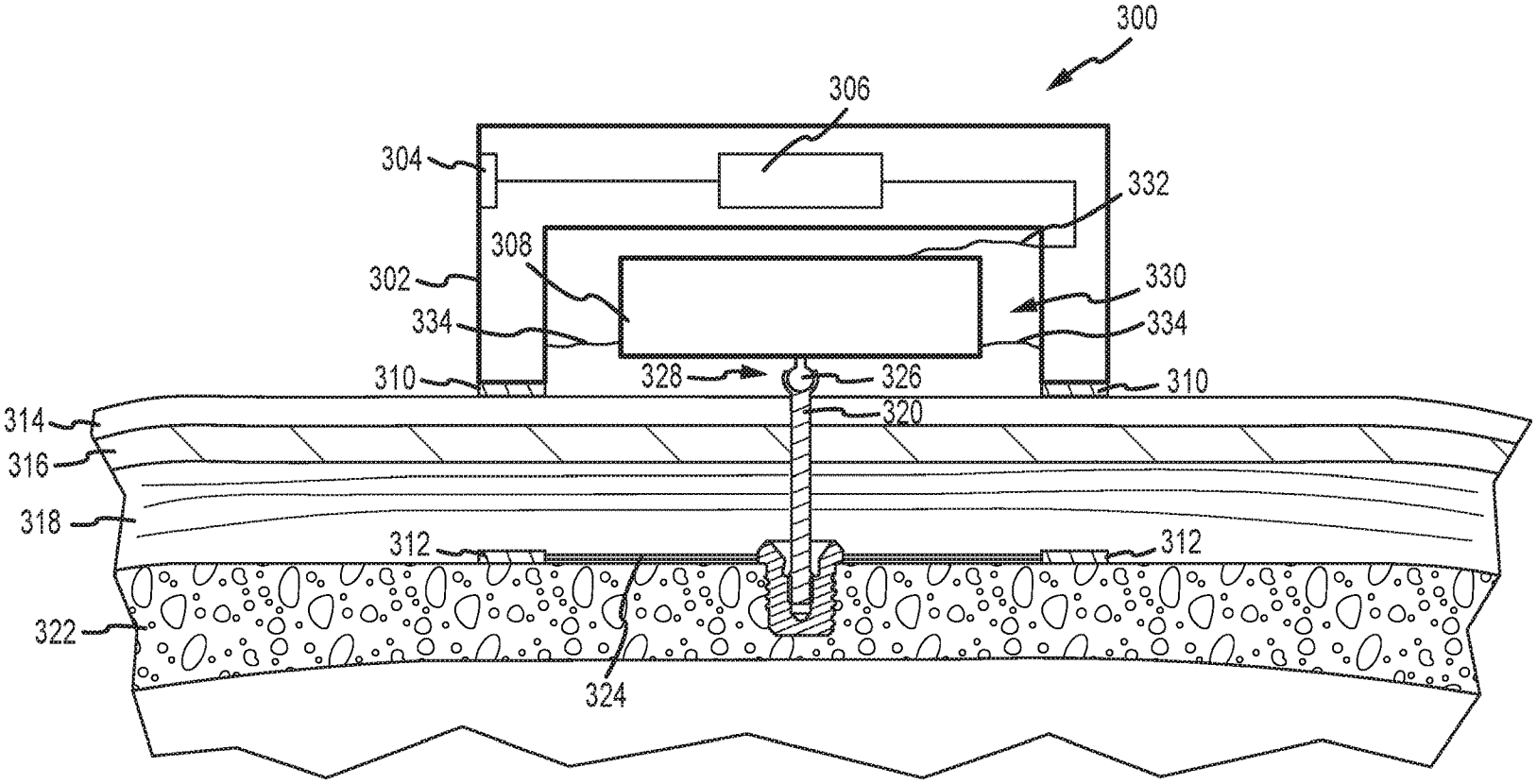
FIG. 3 depicts a cross-sectional schematic view of a mechanically separated passive percutaneous bone conduction device worn on a recipient.

FIG. 3 depicts a cross-sectional schematic view of a mechanically separated passive percutaneous bone conduction device 300 worn on a recipient. The device 300 includes a wearable auditory prosthesis housing 302 that contains a microphone 304 that is communicatively coupled to a sound processor 306. A vibration actuator 308 is nested within the auditory prosthesis housing 302 and includes no mechanical connectors that permanently retain the vibration actuator 308 in a substantially fixed position relative to the housing 302. Additional elements, such as the interface and power modules depicted in FIG. 1B are also located therein, but are not depicted for clarity. Unlike the percutaneous bone conduction device of FIGS. 1A and 1B, a vibration actuator 308 is mechanically separate from the auditory prosthesis housing 302. As there are no mechanical couplings that secure the vibration actuator 308 to the housing 302, feedback from the actuator through the housing to the microphone 305 is reduced or potentially eliminated, resulting in improved performance. Both the auditory prosthesis housing 302 and the vibration actuator 308 are secured to the recipient by their own discrete retention systems, as described in more detail below.

The auditory prosthesis housing 302 includes one or more housing retention elements, in this case in the form of retention magnets 310 connected thereto. These housing retention elements or retention magnets 310 are configured to engage with one or more implantable housing retention magnets 312 when the housing 302 is disposed proximate the recipient's head. The implantable housing retention magnets 312 are implanted below the skin 314, fat 316, and muscle 318 of the head. The implantable housing retention magnets 312 can form an integral unit with a connector 320 that penetrates the skull 322, e.g., by being connected thereto with an implantable plate 324. In other examples, the connector 320 can be connected to the implantable housing retention magnets 312 with one or more arms projecting therefrom. By making the connector 320 and implantable housing retention magnets 312 integral, alignment between the various retention elements of the external and implantable components is ensured. The connector 320 extends through the skin 314, fat 316, and muscle 318 and is configured to function as an implantable retention element. The connector 320 is configured to be secured to an actuator retention element in the form of a transmission abutment 326 with a snap, magnetic, or other connection element 328. In this example, a mating ball and socket-type configuration is utilized. The abutment 326 projects from the vibration actuator 308 and transmits vibrational stimuli to the skull bone 322 of the recipient, via the connector 320.

As can be seen in FIG. 3, the vibration actuator 308 is nested within a void or interior chamber 330 formed by the auditory prosthesis housing 302. Although the void 330 is centrally located within the housing 302, the void 330 can be off center in other examples. In other examples, the vibration actuator 308 need not be contained within the void 330 the auditory prosthesis housing 302 as shown. Instead, the vibration actuator can be disposed remote from the housing that contains the sound processor and microphone. The implantable retention elements (e.g., magnets and/or abutments) would be relocated in such an example. The vibration actuator 308 is mechanically separated from the auditory prosthesis housing 302 in that no mechanical connectors retain the vibration actuator in a substantially fixed position relative to the housing 302. Instead, the vibration actuator 308 is only coupled to the housing 302 at one or more electrical leads 332. In another example, the electrical leads 332 can be eliminated in favor of wireless transceivers (units that perform both the function of a signal transmitter and a signal receiver) on both the vibration actuator 308 and the housing 302. In the depicted example, a sealing element or membrane 334 connects the vibration actuator 308 to the auditory prosthesis housing 302. The sealing membrane 334 can also be disposed between the housing retention magnets 310 and the connector 320. The sealing membrane 334 can be a thin film, coated fabric, or plastic that helps prevent intrusion of debris, water, sweat, etc., into the void 330. While the sealing membrane 334 connects the vibration actuator 308 and the housing 302, it does not act as a mechanical coupling since it does not maintain the vibration actuator 308 in a substantially fixed position relative to the housing 302 during removal and application of the device 300. As such, the mechanically separated bone conduction device 300 differs from prior art devices that can utilize flexible connectors to secure a vibration actuator to a housing thereof. Ultimately, such flexible connectors can still transmit vibration to the microphone of the device. Reduction of feedback increases as the sealing membrane 334 and leads 332 are made very thin or weak. In that case, the construction of the sealing membrane 334 and leads 332 are the minimum required to perform their required function but not so robust as to mechanically couple the vibration actuator 308 to the housing 302. As such, the sealing membrane 334 and electrical leads 332 can fail or rupture when the auditory prosthesis housing 302 is pulled away from the head if the vibration actuator retention element 326 remains engaged with the connector 320. This failure occurs because there is no mechanical connection between the housing 302 and actuator 308. Releasable holders in the form of active and passive engagement elements that prevent such failure are described below.

Figure 4:
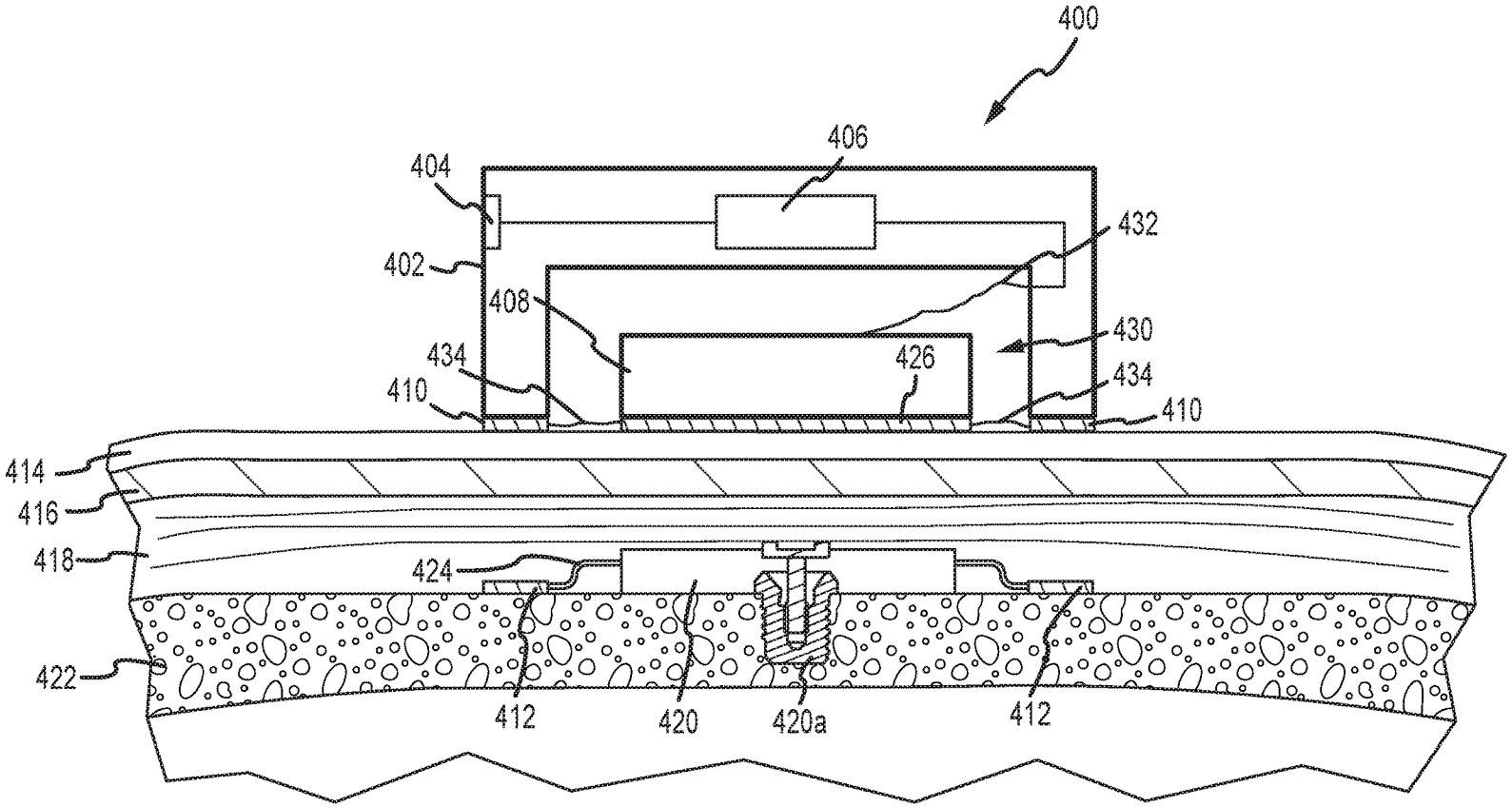
FIG. 4 depicts a cross-sectional schematic view of a mechanically separated passive transcutaneous bone conduction device worn on a recipient.

FIG. 4 depicts a cross-sectional schematic view of a mechanically separated passive transcutaneous bone conduction device 400 worn on a recipient. The device 400 includes a wearable auditory prosthesis housing 402 that contains a microphone 404 that is communicatively coupled to a sound processor 406. Additional elements, such as the interface and power modules depicted in FIG. 1B are also located therein, but are not depicted for clarity. Unlike the transcutaneous bone conduction device of FIG. 2, a vibration actuator 408 is mechanically separate from the auditory prosthesis housing 402, thus resulting in reduced feedback. Both the auditory prosthesis housing 402 and the vibration actuator 408 are secured to the recipient by their own discrete retention systems, as described in more detail below.

The auditory prosthesis housing 402 includes one or more housing retention elements, in this case in the form of retention magnets 410 connected thereto. These housing retention elements or retention magnets 410 are configured to engage with one or more implantable housing retention magnets 412 that engage when the housing 402 is disposed proximate the recipient's head. The implantable housing retention magnets 412 are implanted below the skin 414, fat 416, and muscle 418 of the head, and can form an integral unit with an implantable retention element 420. In this case, the implantable retention element 420 is one or more implantable actuator retention magnets that are secured to the skull 422 with an anchor 420*a*. The implantable actuator retention magnet 420 is connected to the implantable housing retention magnets 412 with an implantable plate 424 or one or more arms. The implantable actuator retention magnet 420 is configured to engage magnetically with an actuator retention element in the form of a vibration actuator retention magnet 426, which may be disposed within a transmission plate (as depicted) that transmits vibrational stimuli to the skull bone 422 of the recipient. In other examples, the vibration actuator retention magnet 426 can be discrete from a transmission plate that transmits vibrational stimuli to the skull bone 422 of the recipient.

As can be seen in FIG. 4, the vibration actuator 408 is disposed within a void or interior chamber 430 formed by the auditory prosthesis housing 402. As with the example of FIG. 3, the vibration actuator 408 is mechanically separated from the auditory prosthesis housing 402 in that no mechanical connectors retain the vibration actuator 408 in a substantially fixed position relative to the housing 402. Instead, the vibration actuator 408 is only coupled to the housing 402 at one or more electrical leads 432. In the depicted example, a sealing membrane 434 connects the vibration actuator retention magnet 426 to the auditory prosthesis housing retention magnet 402. The sealing membrane 434 can be disposed elsewhere so as to seal the void 430. Releasable holders in the form of active and passive engagement elements that prevent damage to the sealing element or membrane 434 and/or the electrical leads 432 are described below.

Figure 5:
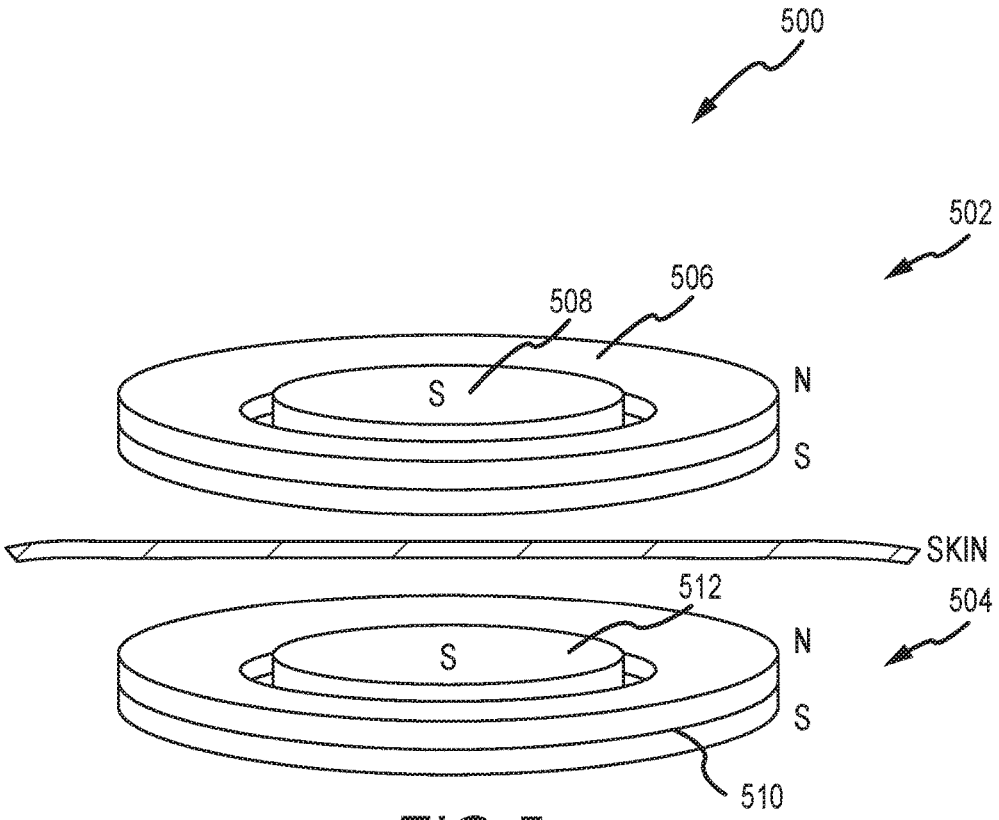
FIGS. 5 and 6 depict examples of external and implantable retention magnet systems for mechanically separated transcutaneous bone conduction devices.

FIG. 5 depicts an example of an external and implantable retention magnet systems 500 for mechanically separated transcutaneous bone conduction devices. In the depicted configuration, each of an external retention magnet set 502 and an implantable retention magnet set 504 includes two magnets. For the external retention magnet set 502, an external outer retention magnet 506 is disposed so as to be secured to an auditory prosthesis housing (not shown), while an external inner retention magnet 508 is disposed so as to be secured to a vibration actuator (not shown). The polarities of the two external retention magnets 506, 508 are reversed. More specifically, the external outer retention magnet 506 depicts a north pole facing upward (away from the skin surface S) while the external inner retention magnet 508 depicts a south pole facing upward (the north pole of the external inner retention magnet 506 is not visible in this figure). For the implantable retention magnet set 504, an implantable outer retention magnet 510 is disposed so as to magnetically engage with the external outer retention magnet 506, while an implantable inner retention magnet 512 is disposed so as to magnetically engage with the external inner retention magnet 508. The implantable outer retention magnet 510 depicts a north pole facing upward (toward the skin surface S) while the implantable inner retention magnet 512 depicts a south pole facing upward (the north pole of the implantable inner retention magnet 512 is not visible in this figure). By reversing the orientation of the outer and inner retention magnets of both the external retention magnet set 502 and the implantable retention magnet set 504, the vibration actuator connected to the external inner retention magnet 508 should remain centered within the auditory prosthesis housing connected to the external outer retention magnet 504. Although the retention magnet sets 502, 504 depict ring-shaped outer retention magnets and circular inner retention magnets, other shaped retention magnets can be utilized. For example, both outer and inner retention magnets can be ring-shaped, crescent-shaped, circular, square, oblong, and so on. Other retention magnet configurations are contemplated.

Figure 6:
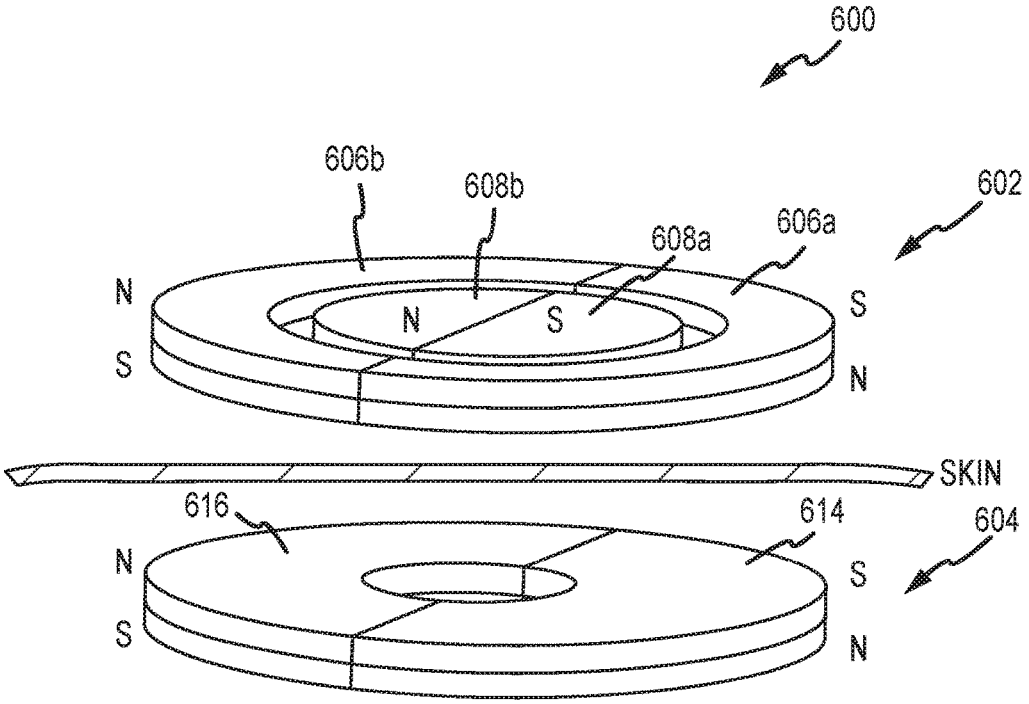

For example, FIG. 6 depicts another example of an external and implantable retention magnet system 600 for mechanically separated transcutaneous bone conduction devices. In the depicted configuration, each of an external retention magnet set 602 and an implantable retention magnet set 604 include a plurality of magnets, positioned as described below. For the external retention magnet set 602, an external outer retention magnet 606 is disposed so as to be secured to an auditory prosthesis housing (not shown), while an external inner retention magnet 608 is disposed so as to be secured to a vibration actuator (not shown). The external retention magnets 606, 608 can be secured to their associated component (e.g. via an adhesive) or can be integrated into said component. The external outer retention magnet 606 includes two external outer parts 606*a*, 606*b*, the polarities of which are reversed. More specifically, the external outer part 606*a* depicts a north pole facing downward (toward the skin surface S), while the external outer part 606*b* depicts a north pole facing upward (away from the skin surface S). The external inner retention magnet 608 includes two external inner parts 608*a*, 608*b*, the polarities of which are reversed. More specifically, the external inner part 608*a* depicts a north pole facing downward (toward the skin surface S), while the external inner part 608*b* depicts a north pole facing upward (away from the skin surface S). As such, external retention magnet parts 606*a*, 608*a* have the same polar orientation, while external retention magnet parts 606*b*, 608*b* have a polar orientation that is opposite to that of retention magnet parts 606*a*, 608*a*. This configuration allows the external retention magnet set 602 to engage with a differently-configured implantable retention magnet set 604, as described below. In another example, the polarities of each of the retention magnets in the retention magnet system 600 can be reversed without adversely effecting performance.

The implantable retention magnet set 604 includes two magnets 614, 616, each having a substantially crescent-shaped configuration. This retention magnet set 604 is available commercially as part of the Baha™ Attract System, available from Cochlear Limited, of Australia. By using the external retention magnet set 602 having the configuration depicted in FIG. 6, an existing recipient of the implantable retention magnet set 604 can still derive the benefits of a mechanically separated transcutaneous bone conduction device without having to have her existing implantable retention magnet set removed. The implantable retention magnet 614 depicts a north pole facing downward (away from the skin surface S) while the implantable retention magnet 616 depicts a north pole facing upward (toward the skin surface S). As such, external retention magnet parts 606*a*, 608*a* are configured to magnetically engage with implantable retention magnet 614, while external retention magnet parts 606*b*, 608*b* are configured to magnetically engage with implantable retention magnet 616. Another advantage to this configuration is the polarities allow for only a single magnetic engagement orientation between the external retention magnet set 602 and the implantable retention magnet set 604. This can help ensure that the auditory prosthesis housing is properly positioned on the skull (e.g., such that directional microphones are facing in optimal directions).

Figure 7A:
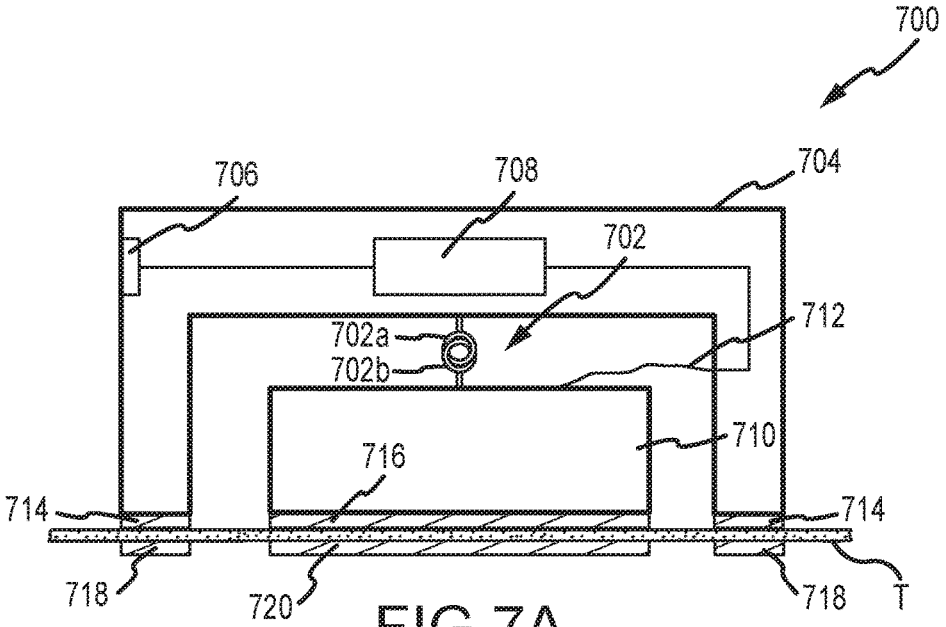
FIGS. 7A and 7B depict a mechanically separated transcutaneous bone conduction device utilizing an example of a passive engagement element.
Figure 7B:
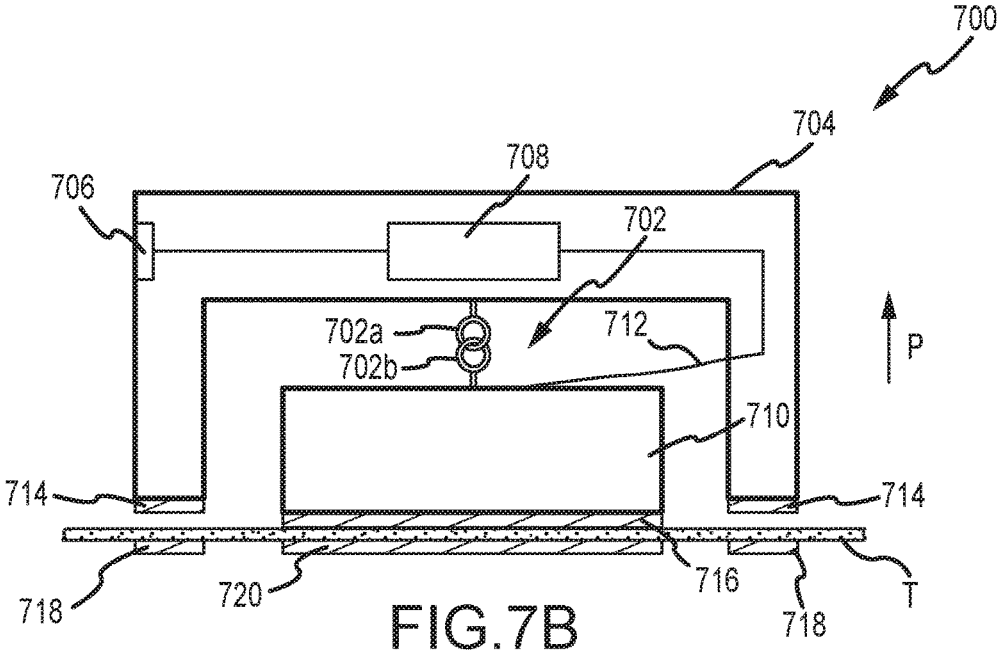

FIGS. 7A and 7B depict a mechanically separated transcutaneous bone conduction device 700 utilizing an example of a passive engagement element 702, in this case, a pair of engageable elements. In FIGS. 7A and 7B, the skin, fat, and muscle of the recipient have been depicted as tissue T for clarity; recipient bone is not depicted. FIGS. 7A and 7B are described simultaneously. Components and functionality of mechanically separated transcutaneous bone conduction devices are described elsewhere herein and therefore, not all components are depicted or described in association with FIGS. 7A and 7B. As described elsewhere herein, the mechanically separated transcutaneous bone conduction device 700 includes a housing 704 that contains a microphone 706 and a sound processor 708. The housing 704 is electrically connected to a vibration actuator 710 only via an electrical lead 712, and without any mechanical connections. Each of the housing 704 and the vibration actuator 710 include their own dedicated and discrete retention magnet(s) 714, 716, respectively. The housing retention magnet 714 magnetically engages with an implantable housing retention magnet 718, while the actuator retention magnet 716 magnetically engages with an implantable actuator retention magnet 720. In alternative examples, other magnetic configurations, such as those described above in FIG. 6, can be utilized. A sealing mechanism can be utilized but is not depicted. Since the electrical lead 712 is generally not sufficiently robust to overcome the magnetic retention force of retention magnets 716, 720, a passive engagement element 702 is included. In this case, the passive engagement element 702 includes two mating hooks, eyelets, or other links 702*a*, 702*b*. When the device 700 is worn on the head (e.g., when the external housing retention magnet 714 is magnetically engaged with the implantable housing retention magnet 718, and the external actuator retention magnet 716 is engaged with the implantable actuator retention magnet 720), there is no contact between the two mating eyelets 702*a*, 702*b*. As the housing 704 is pulled P away from the head, as depicted in FIG. 7B, the upper eyelet 702*a* moves with the housing 704 a predetermined distance until it engages with the lower eyelet 702*b*. This provides sufficient mechanical force to overcome the magnetic force of retention magnets 716, 720. As such, the vibration actuator 710 pulls away from the head as well. Without the passive engagement element 702, it is likely that the electrical lead 712 would not have sufficient robustness to overcome the magnetic holding force of the retention magnets 716, 720 and could fail, immediately or over time. Even though the vibration actuator 710 is now mechanically engaged with the housing 704 via the passive engagement element 702, it will still be disengaged or separated when the actuator retention magnets 716, 720 are magnetically engaged and the housing retention magnets 714, 718 are magnetically engaged. As such, the device 700 is still referred to as being mechanically separated, since when worn on a recipient's head, there is no mechanical connection between the vibration actuator 710 and housing 704 sufficient to overcome the magnetic retention force of the retention magnets 716, 720, should the device 300 be pulled P away from the head. This is significantly different than the flexible connectors utilized in known bone conduction devices.

Figure 8A:
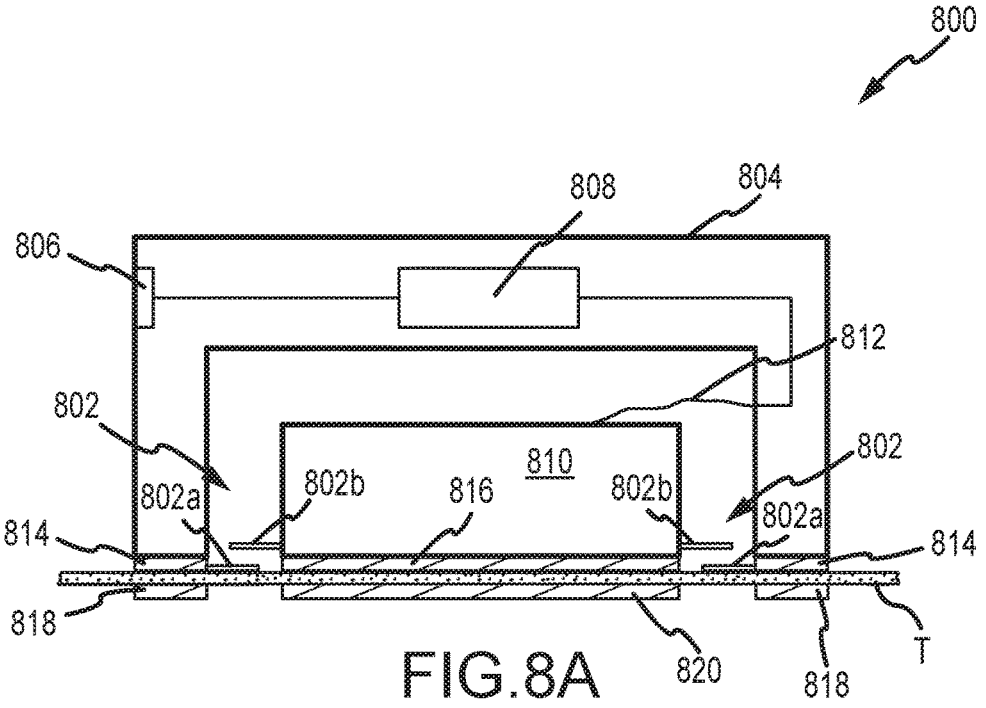
FIGS. 8A and 8B depict a mechanically separated transcutaneous bone conduction device utilizing another example of a passive engagement element.
Figure 8B:
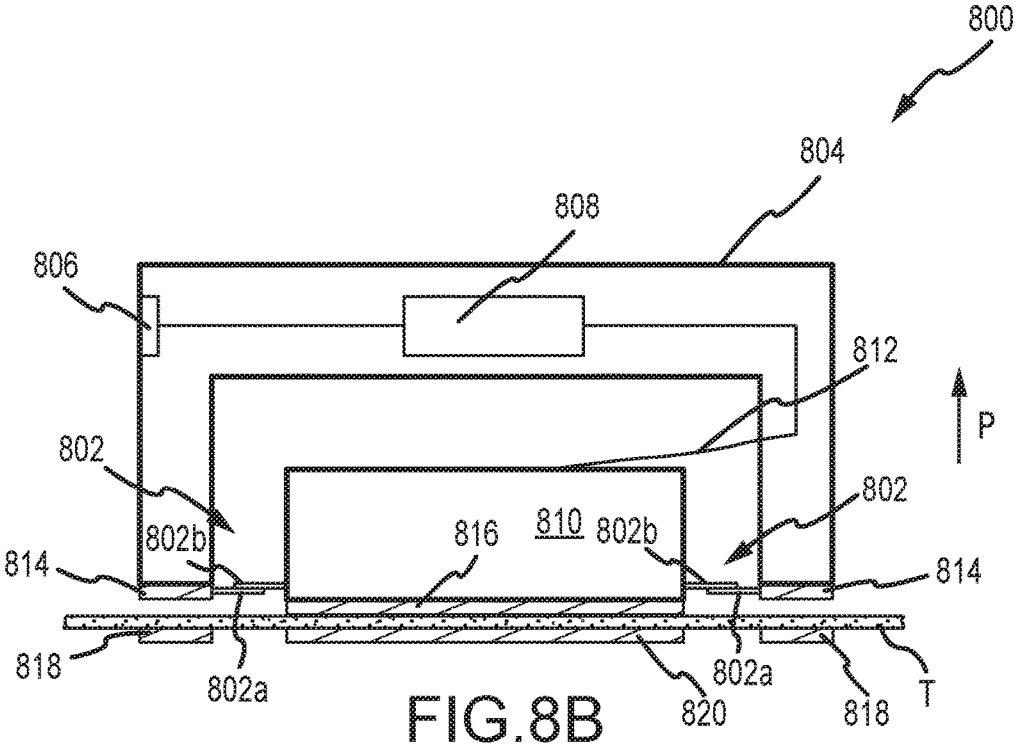

FIGS. 8A and 8B depict a mechanically separated transcutaneous bone conduction device 800 utilizing another example of a passive engagement element 802, in this case, engaging and aligned ledges or lugs. In FIGS. 8A and 8B, the skin, fat, and muscle of the recipient have been depicted as tissue T for clarity; recipient bone is not depicted. FIGS. 8A and 8B are described simultaneously. As described elsewhere herein, the mechanically separated transcutaneous bone conduction device 800 includes a housing 804 that contains a microphone 806 and a sound processor 808. The housing 804 is electrically connected to a vibration actuator 810 only via an electrical lead 812, and without any mechanical connections. Each of the housing 804 and the vibration actuator 810 include their own dedicated and discrete retention magnet(s) 814, 816, respectively. The housing retention magnet 814 magnetically engages with an implantable housing retention magnet 818, while the actuator retention magnet 816 magnetically engages with an implantable actuator retention magnet 820. A sealing mechanism can be utilized. The passive engagement element 802 includes mating ledges or lugs 802*a*, 802*b* that project from the housing 804 and the actuator 810, respectively. When the device 800 is worn on the head (e.g., when the external housing retention magnet 814 is magnetically engaged with the implantable housing retention magnet 818, and the external actuator retention magnet 816 is engaged with the implantable actuator retention magnet 820), there is no contact between the ledges 802*a*, 802*b*. As the housing 804 is pulled P away from the head, as depicted in FIG. 8B, the lower ledge 802*a* moves with the housing 804 until it engages with the actuator ledge 802*b*. This provides sufficient mechanical force to overcome the magnetic force of actuator retention magnets 816, 820. As such, the vibration actuator 810 pulls away from the head as well. Even though the vibration actuator 810 is now mechanically engaged with the housing 804 via the passive engagement element 802, it will still be disengaged or separated when the actuator retention magnets 816, 820 are magnetically engaged and the housing retention magnets 814, 818 are magnetically engaged. As such, the device 800 is still referred to as being mechanically separated. FIGS. 7A-8B depict so-called passive engagement elements that do not require any user action (other than pulling P) prior to engaging the elements. Also, although FIGS. 7A-7B depict passive engagement elements utilized with mechanically separated transcutaneous bone conduction devices, configurations for passive engagement elements for mechanically separated percutaneous bone conduction devices will be apparent to a person of skill in the art.

Figure 9A:
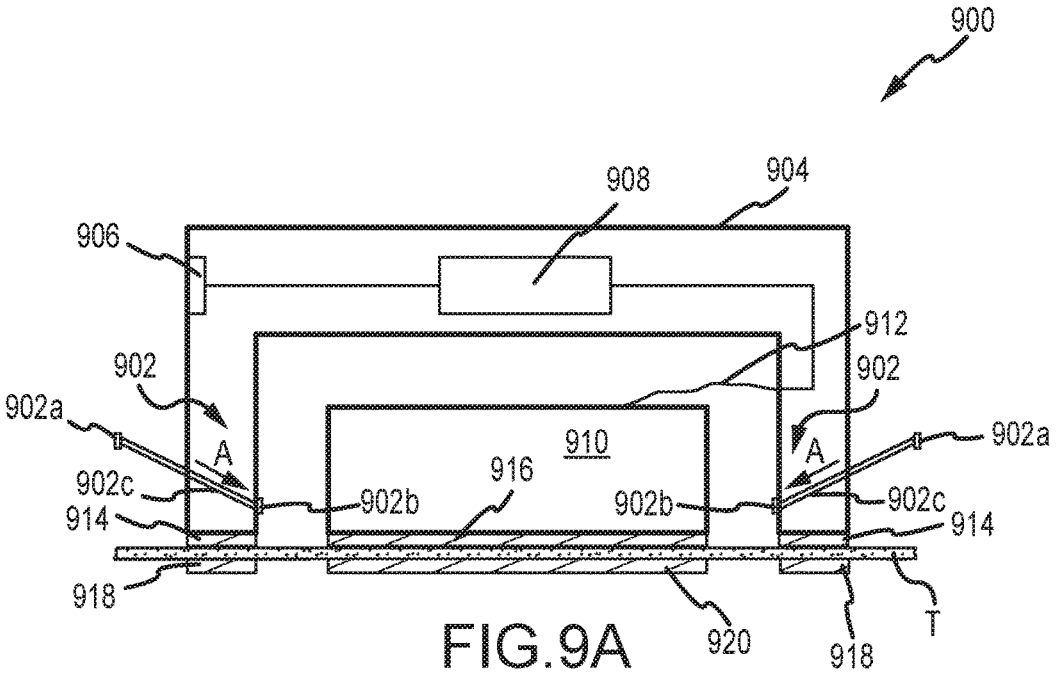
FIGS. 9A and 9B depict a mechanically separated transcutaneous bone conduction device utilizing an example of an active engagement element.
Figure 9B:
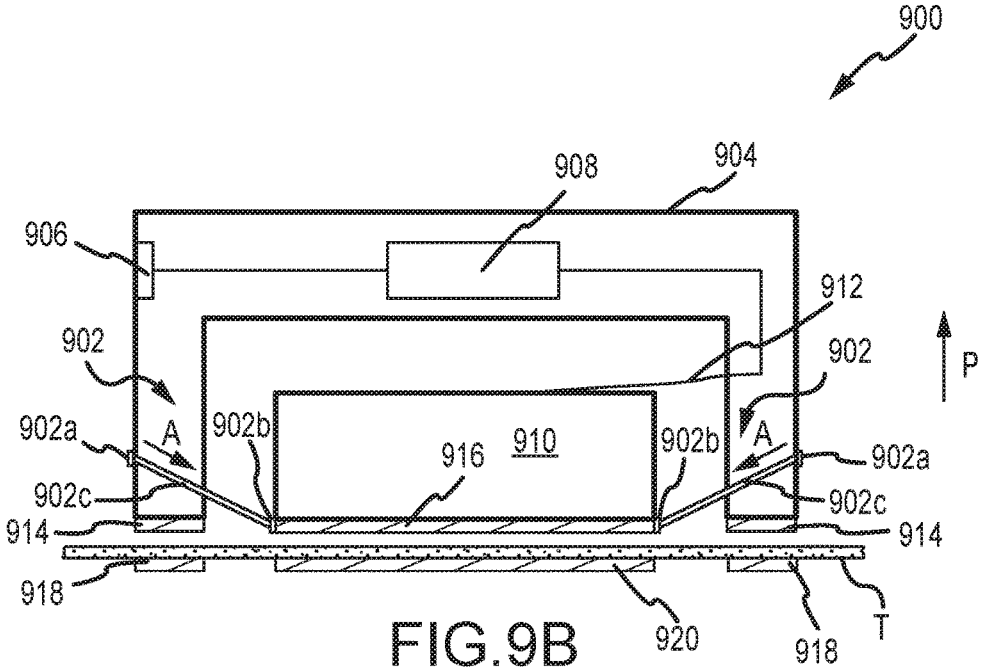

FIGS. 9A and 9B depict a mechanically separated transcutaneous bone conduction device 900 utilizing an example of an active engagement element 902, in this case, actuable retention magnets. In FIGS. 9A and 9B, the skin, fat, and muscle of the recipient have been depicted as tissue T for clarity; recipient bone is not depicted. FIGS. 9A and 9B are described simultaneously. As described elsewhere herein, the mechanically separated transcutaneous bone conduction device 900 includes a housing 904 that contains a microphone 906 and a sound processor 908. The housing 904 is electrically connected to a vibration actuator 910 only via an electrical lead 912, and without any mechanical connections. Each of the housing 904 and the vibration actuator 910 include their own dedicated and discrete retention magnet(s) 914, 916, respectively. The housing retention magnet 914 magnetically engages with an implantable housing retention magnet 918, while the actuator retention magnet 916 magnetically engages with an implantable actuator retention magnet 920. A sealing mechanism can be utilized. The active engagement element 902 acts as a selectively releasable holder of the vibration actuator 910 and includes an actuatable button 902*a* connected by an actuatable lever or bar 902*c* to a retention magnet 902*b*. Two engagement elements 902 are utilized, but greater than or fewer than two can be used in certain examples. When the device 900 is worn on the head (e.g., when the external housing retention magnet 914 is magnetically engaged with the implantable housing retention magnet 918, and the external actuator retention magnet 916 is engaged with the implantable actuator retention magnet 920), there is no contact between the engagement element 902 and the actuator 910. Before the housing 904 is pulled away from the head, the button 902*a* is actuated in a direction A, which moves retention magnet 902*b* so as to engage actuator retention magnet 916. This magnetic engagement is sufficient to overcome the magnetic holding force between actuator retention magnets 916, 920, as the housing 904 is pulled P away from the head. As the housing 904 is pulled P away from the head, the housing 904 and vibration actuator 910 move together. Even though the vibration actuator 910 is now mechanically engaged with the housing 904 via the active engagement element 902, it will still be actively disengaged or separated when the actuator retention magnets 916, 920 are magnetically engaged and the magnets housing 914, 918 are magnetically engaged. As such, the device 900 is still referred to as being mechanically separated.

Figure 10A:
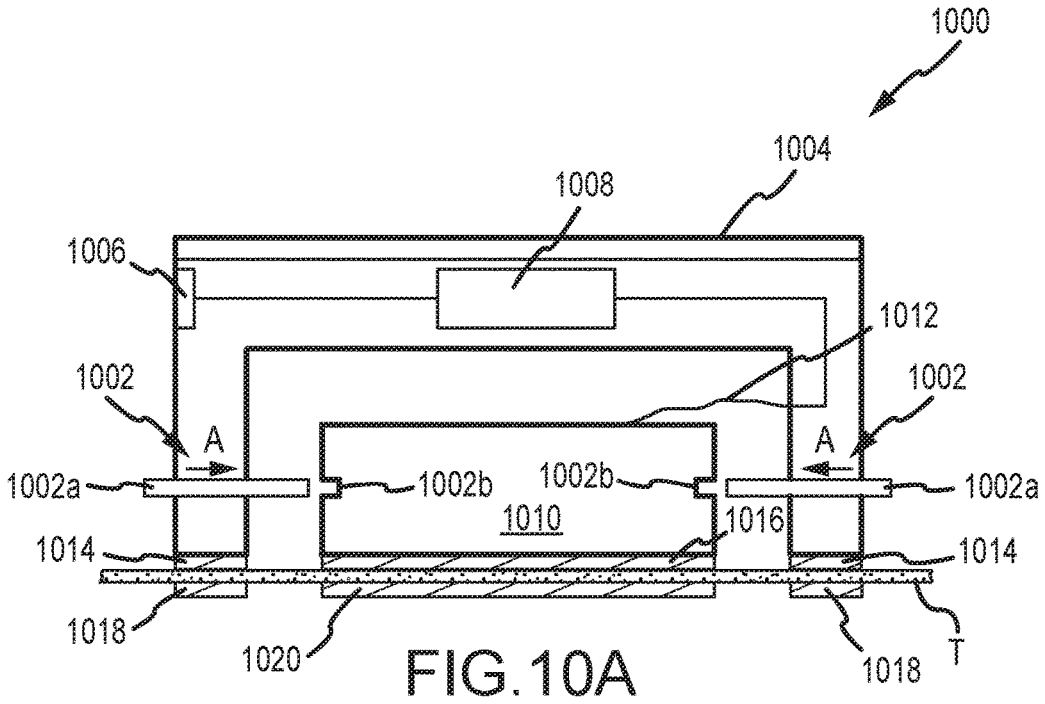
FIGS. 10A and 10B depict a mechanically separated transcutaneous bone conduction device utilizing another example of an active engagement element.
Figure 10B:
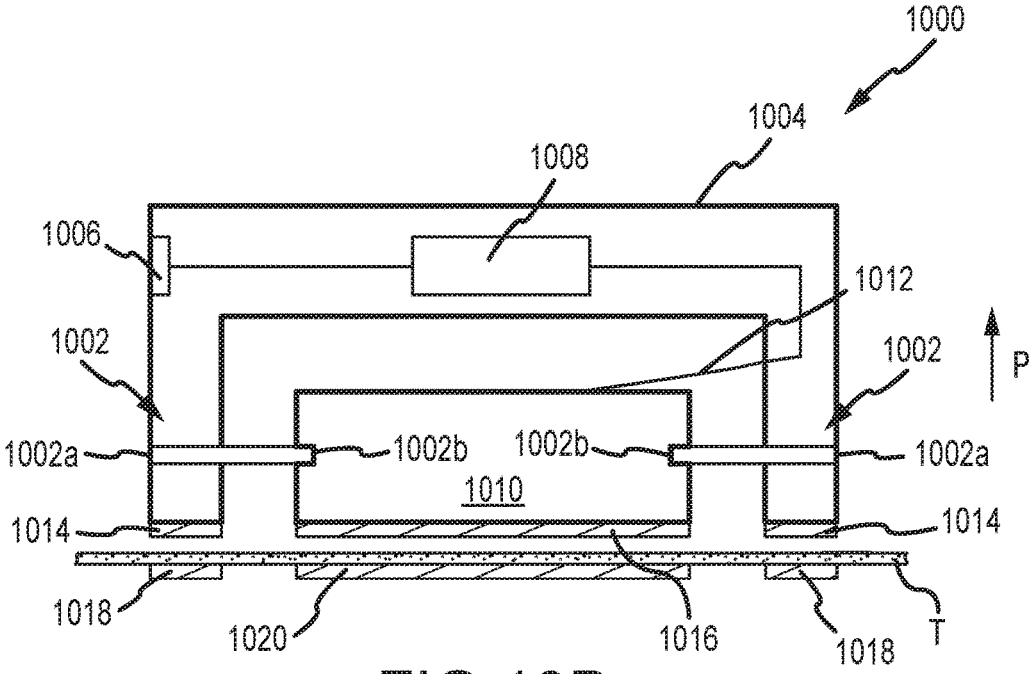

FIGS. 10A and 10B depict a mechanically separated transcutaneous bone conduction device 1000 utilizing another example of an active engagement element 1002, in this case, an actuable bar lock. In FIGS. 10A and 10B, the skin, fat, and muscle of the recipient have been depicted as tissue T for clarity; recipient bone is not depicted. FIGS. 10A and 10B are described simultaneously. As described elsewhere herein, the mechanically separated transcutaneous bone conduction device 1000 includes a housing 1004 that contains a microphone 1006 and a sound processor 1008. The housing 1004 is electrically connected to a vibration actuator 1010 only via an electrical lead 1012, and without any mechanical connections. Each of the housing 1004 and the vibration actuator 1010 include their own dedicated and discrete retention magnet(s) 1014, 1016, respectively. The housing retention magnet 1014 magnetically engages with an implantable housing retention magnet 1018, while the actuator retention magnet 1016 magnetically engages with an implantable actuator retention magnet 1020. A sealing mechanism can be utilized. The actuatable bar lock 1002 acts as a selectively releasable holder of the vibration actuator 1010 and includes a key 1002*a* that mates with a recess 1002*b* in the vibration actuator 1010. Two actuatable bar locks 1002 are utilized, but greater than or fewer than two can be used in certain examples. When the device 1000 is worn on the head (e.g., when the external housing retention magnet 1014 is magnetically engaged with the implantable housing retention magnet 1018, and the external actuator retention magnet 1016 is engaged with the implantable actuator retention magnet 1020), there is no contact between the actuatable bar lock 1002 and the actuator 1010. Before the housing 1004 is pulled away from the head, the key 1002*a* is actuated in a direction A, so as to engage with the recess 1002*b*. This engagement is sufficient to overcome the magnetic holding force between actuator retention magnets 1016, 1020, as the housing 1004 is pulled P away from the head. As the housing 1004 is pulled P away from the head, the housing 1004 and vibration actuator 1010 move together. Even though the vibration actuator 1010 is now mechanically engaged with the housing 1004 via the actuatable bar lock 1002, it will still be actively disengaged or separated when the actuator retention magnets 1016, 1020 are magnetically engaged and the housing retention magnets 1014, 1018 are magnetically engaged. As such, the device 1000 is still referred to as being mechanically separated. FIGS. 9A-10B depict so-called active engagement elements that require user action so as to engaging the elements. Also, although FIGS. 9A-10B depict active engagement elements utilized with mechanically separated transcutaneous bone conduction devices, configurations for active engagement elements for mechanically separated percutaneous bone conduction devices will be apparent to a person of skill in the art.

As described herein, the retention magnets can be of virtually any form factor or shape, as required or desired for a particular application. Contemplated shapes include rectangular, crescent, triangular, trapezoidal, circle segments, and so on. Additionally, substantially plate-like or flat retention magnets are disclosed in several embodiments, but retention magnets having variable thicknesses are also contemplated.

This disclosure described some embodiments of the present technology with reference to the accompanying drawings, in which only some of the possible embodiments were shown. Other aspects, however, can be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An apparatus comprising:

an auditory prosthesis housing;

a sound processor disposed in the auditory prosthesis housing;

a vibration actuator mechanically disposed within the auditory prosthesis housing and separate from the auditory prosthesis housing;

a housing retention element fixed to the auditory prosthesis housing; and an actuator retention element discrete from the housing retention element and fixed relative to the vibration actuator.

2. The apparatus of claim 1, further comprising:

a transmission plate connected to the vibration actuator, and wherein the actuator retention element includes an external actuator retention magnet connected to the transmission plate.

3. The apparatus of claim 1, wherein:

the actuator retention element is rigidly secured to an output shaft of the vibration actuator, and the housing retention element is rigidly secured to the auditory prosthesis housing and vibrationally isolated from the output shaft of the vibration actuator.

4. The apparatus of claim 1, further comprising:

a sealing element connecting the actuator retention element to at least one of the auditory prosthesis housing and the housing retention element.

5. The apparatus of claim 1, further comprising a releasable holder for engageably securing the vibration actuator to the auditory prosthesis housing.

6. The apparatus of claim 5, wherein the releasable holder includes an active engagement element including at least one of an actuatable button, an actuatable lever, and an actuatable locking magnet.

7. The apparatus of claim 5, wherein the releasable holder includes a first passive engagement element connected to the vibration actuator and a second passive engagement element connected to the auditory prosthesis housing.

8. The apparatus of claim 7, further comprising: a first implantable retention magnet adapted to engage with the housing retention element, and wherein the first passive engagement element and the second passive engagement element are disengaged when the housing retention element is engaged with the first implantable retention magnet.

9. An apparatus comprising:

an external auditory prosthesis including:

an external housing;

an external housing retention magnet connected to the external housing;

a sound processor disposed within the external housing; and a microphone disposed within the external housing and communicatively coupled to the sound processor; and a vibration actuator including:

a vibration actuator retention element connected to the vibration actuator and discrete from the external housing retention magnet.

10. The apparatus of claim 9, further comprising:

an implantable portion comprising:

an implantable retention magnet configured to engage with the external housing retention magnet when the external auditory prosthesis is placed proximate a skull of a recipient; and an implantable retention element discrete from the implantable retention magnet, wherein the vibration actuator retention element engages the vibration actuator to the implantable retention element.

11. The apparatus of claim 10, wherein the vibration actuator retention element comprises at least one of a vibration actuator retention magnet and an abutment.

12. The apparatus of claim 10, wherein the external auditory prosthesis and the vibration actuator each comprise a passive engagement element, wherein each of the passive engagement elements are not in contact when the vibration actuator retention element is engaged with the implantable retention element and when the external housing retention magnet is engaged with the implantable retention magnet.

13. The apparatus of claim 12, wherein the passive engagement elements comprise aligned ledges extending from both the external auditory prosthesis and the vibration actuator.

14. The apparatus of claim 12, wherein when the vibration actuator retention element is engaged with the implantable retention element and when the external housing retention magnet is engaged with the implantable retention magnet, the vibration actuator is physically connected to the external housing only via an electrical connection between the vibration actuator and the sound processor.

15. The apparatus of claim 9, wherein:

the vibration actuator is nested within the external housing, and the vibration actuator is not connected to the external housing during use.

16. The apparatus of claim 9, wherein the external auditory prosthesis further comprises a wireless transmitter; and the vibration actuator further comprises a wireless receiver in communication with the wireless transmitter.

17. An apparatus comprising:

a wearable portion of an auditory prosthesis, wherein the wearable portion is configured to be worn by a recipient and wherein the wearable portion includes:

a housing containing a sound processor;

a housing retention magnet connected to the housing;

a vibration actuator nested within the housing; and a vibration actuator retention magnet connected to the vibration actuator, wherein the housing retention magnet is configured to couple only the housing to the recipient, and wherein the vibration actuator retention magnet is configured to couple only the vibration actuator to the recipient.

18. The apparatus of claim 17, wherein the vibration actuator is centrally located within the housing.

19. The apparatus of claim 17, further comprising a passive holding element for securing the vibration actuator within an open void within the housing when the housing retention magnet is disengaged from a first implantable retention magnet and the vibration actuator retention magnet is disengaged from a second implantable retention magnet.

20. The apparatus of claim 19, wherein the passive holding element comprises one or more mechanical stops that selectively engage the vibration actuator and the housing.

* * * * *